US005447095A

United States Patent [19]

Weyer

[11] Patent Number: 5,447,095

[45] Date of Patent: Sep. 5, 1995

[54] ACTUATOR WITH RING GEAR AND METHOD OF MANUFACTURING SAME

[76] Inventor: Paul P. Weyer, P.O. Box 398, Enumclaw, Wash. 98022

[21] Appl. No.: 277,341

[22] Filed: Jul. 18, 1994

[51] Int. Cl.[6] ..... F01B 3/00; F01B 9/00

[52] U.S. Cl. ..... 92/33; 92/110; 92/116; 92/136; 29/888.06

[58] Field of Search ..... 29/888.06, 888.061; 92/31, 33, 110, 116, 136

[56] References Cited

U.S. PATENT DOCUMENTS

| | | | |
|---|---|---|---|
| 4,274,329 | 6/1981 | Weyer | 92/136 X |
| 4,960,007 | 10/1990 | Weyer | 92/33 X |
| 5,038,672 | 8/1991 | Beuschau | 92/116 X |
| 5,046,402 | 9/1991 | Lagace | 92/33 |
| 5,054,372 | 10/1991 | Weyer | 92/33 X |
| 5,299,489 | 9/1994 | Obrecht et al. | 92/31 X |

FOREIGN PATENT DOCUMENTS

| | | | |
|---|---|---|---|
| 3033754 | 3/1982 | Germany | 92/33 |

*Primary Examiner*—Edward K. Look
*Assistant Examiner*—Hoang Nguyen
*Attorney, Agent, or Firm*—Seed and Berry

[57] ABSTRACT

A fluid-powered rotary actuator having a body with a cylindrical interior sidewall portion. A drive shaft extends generally coaxially within the body and is supported for rotation relative thereto. The shaft has a grooved, outwardly facing circumferential sidewall portion positioned within the body. A ring gear is positioned generally coaxially within the body and extends about the shaft with an annular space therebetween. The ring gear has a grooved, inwardly facing circumferential sidewall portion. The ring gear is formed as a separate part from the body and the ring gear grooved sidewall portion is formed prior to positioning of the ring gear in the body. The ring gear is fixedly attached to the body to prevent rotation therebetween by a weld between the ring gear and the body interior sidewall portion. A stop member is engaged by the ring gear. The stop member is axially located within the body to limit movement of the ring gear toward the body first end during assembly of the ring gear in the body. The stop member may be a stop shoulder formed integral with the body interior sidewall portion or a snap ring. In the stop shoulder embodiment, the ring gear is welded to the stop shoulder. A piston sleeve is mounted for reciprocal axial movement within the body in response to the selective application pressurized fluid thereto. An annular sleeve portion thereof is positioned generally coaxially within the body in the annular space between the ring gear and the shaft and extends about the shaft. The sleeve portion has a grooved, inwardly facing circumferential sidewall portion engaging the shaft grooved sidewall portion and a grooved, outwardly facing circumferential sidewall portion engaged with a ring gear grooved sidewall portion to translate axial movement of the piston into clockwise or counterclockwise relative rotational movement between the shaft and the body.

15 Claims, 3 Drawing Sheets

ACTUATOR WITH RING GEAR AND METHOD OF MANUFACTURING SAME

TECHNICAL FIELD

The present invention relates generally to actuators, and more particularly, to fluid-powered rotary actuators in which axial movement of a piston results in relative rotational movement between a body and an output shaft.

BACKGROUND OF THE INVENTION

Rotary helical splined actuators have been employed in the past to achieve the advantage of high-torque output from a simple linear piston-and-cylinder drive arrangement. The actuator typically uses a cylindrical body with an elongated rotary output shaft extending coaxially within the body, with an end portion of the shaft providing the drive output. An elongated annular piston sleeve has a sleeve portion splined to cooperate with corresponding splines on a ring gear attached to the sidewall of the body and on the output shaft exterior. The piston sleeve is reciprocally mounted within the body and has a head for the application of fluid pressure to one or the other opposing sides thereof to produce axial movement of the piston sleeve.

As the piston sleeve linearly reciprocates in an axial direction within the body, the outer splines of the sleeve portion engage the splines of the ring gear to cause rotation of the sleeve portion. The resulting linear and rotational movement of the sleeve portion is transmitted through the inner splines of the sleeve portion to the splines of the shaft to cause the shaft to rotate. Bearings are typically supplied to rotatably support one or both ends of the shaft relative to the body.

A shortcoming of such rotary helical actuators, however, is that the attachment of the ring gear to the body is typically accomplished by pins which each extend through one of a plurality of circumferentially distributed through bore holes in the body sidewall and into a corresponding one of a plurality of circumferentially distributed bore holes in the ring gear. The heads of the pins are then welded to the body sidewall to hold them firmly in position and to prevent fluid leaks. This approach allows the splines of the ring gear to be machined before the ring gear is installed in the body. However, several manufacturing steps are required to form the bore holes in the ring gear and the through bore holes in the body sidewall, install the pins and weld the pin heads to the body sidewall. Not only does this make the manufacture of the actuator more complicated, time-consuming and expensive, but the through bore holes in the body sidewall weakens the body sidewall and presents the possibility of a fluid leak during fluid-powered operation.

Although it is possible to avoid the use of through bore holes in the body by machining the splines directly on the interior surface of the body sidewall, doing so is difficult, time-consuming, and expensive. In part, this is because the splines must be cut on an interior surface of the body along its midportion at a distance from the body ends.

It will therefore be appreciated that there has long been a significant need for a fluid-powered rotary actuator with a ring gear fixedly attached to the body without the use of pins and through bore holes in the body sidewall. The ring gear should be simple and quick to install, eliminate the possibility of fluid leakage during operation and not weaken the body sidewall so as to reduce manufacturing cost and increase reliability. The present invention fulfills these needs and further provides other related advantages.

SUMMARY OF THE INVENTION

The present invention resides in a fluid-powered rotary actuator having a body with a longitudinal axis and first and second ends. The body has a generally cylindrical interior sidewall portion and is adapted for coupling to a first external member. The actuator further includes a drive member extending generally coaxially within the body and supported for rotation relative thereto. The drive member has a grooved, outwardly facing circumferential sidewall portion positioned within the body and an end portion adapted for coupling to a second external member to provide rotational movement between the first and second external members.

The actuator further includes a ring gear positioned generally coaxially within the body and extending about the drive member with an annular space therebetween. The ring gear has a grooved, inwardly facing circumferential sidewall portion. The ring gear is formed as a separate part from the body and the ring gear grooved sidewall portion is formed prior to positioning of the ring gear in the body. The ring gear is fixedly attached to the body to prevent rotation therebetween by a weld between the ring gear and the body interior sidewall portion. In one illustrated embodiment, the ring gear also includes an attachment portion projecting axially away from the ring gear grooved sidewall portion. The attachment portion terminates at a free end axially spaced apart from the ring gear grooved sidewall portion by a separation distance. The weld is formed between the attachment portion free end and the body interior sidewall portion. The separation distance is sufficiently large that the heat of the weld does not distort the ring gear sufficient to impair operation of the actuator.

The actuator has a piston mounted for reciprocal axial movement within the body in response to selective application of pressurized fluid thereto. The actuator further includes a torque transmitting annular member positioned generally coaxially within the body in the annular space between the ring gear and the drive member. The annular member extends about the drive member and is mounted for reciprocal axial movement within the body in response to reciprocal axial movement of the piston. The annular member has a grooved, inwardly facing circumferential sidewall portion engaging the drive member grooved sidewall portion as the annular member reciprocally moves within the body. The annular member further includes a grooved, outwardly facing circumferential sidewall portion engaging the ring gear grooved sidewall portion as the annular member reciprocally moves within the body to translate axial movement of the piston toward the body first end into one of clockwise or counterclockwise relative rotational movement between the drive member and the body, and axial movement of the piston toward the body second end into the other of clockwise or counterclockwise relative rotational movement between the drive member and the body.

The actuator has a stop member engaged by the ring gear. The stop member is axially located within the body toward the body first end to limit movement of the ring gear toward the body first end on assembly of the ring gear in the body. The stop shoulder positions the ring gear grooved sidewall portion in a selected axial position when the weld is formed. In one illustrated embodiment, the stop member is a stop shoulder formed integral with the body interior sidewall portion. In another illustrated embodiment, the stop member is a snap ring held by the body interior sidewall portion against axial movement within the body.

The ring gear has an outer first diameter, and the body interior sidewall portion between the stop member and the body second end has an inner second diameter greater than the first diameter to permit the ring gear to be inserted into the body from the body second end on assembly and moved axially unobstructed towards the body first end and into engagement with the stop member prior to forming the weld.

In the illustrated embodiments, the drive member grooved sidewall portion and the annular member inwardly facing grooved sidewall portion each have splines which slidably intermesh with each other. Further, the ring gear grooved sidewall portion and the annular member outwardly facing grooved sidewall portion each have splines which slidably intermesh with each other.

The invention further includes a method of manufacturing the above-described fluid-powered rotary actuator. The method includes forming the ring gear grooved sidewall portion prior to positioning the ring gear in the body. The ring gear is then positioned in the body and fixedly attached to the body to prevent rotation therebetween by forming a weld between the ring gear and the body interior sidewall portion. The method further includes providing a stop member axially located within the body toward the body first end positioned to limit movement of the ring gear toward the body first end on assembly of the ring gear in the body. The stop member positions the ring gear grooved sidewall portion in a selected axial position when the weld is formed. The ring gear is positioned within the body in engagement with the stop member.

Other features and advantages of the invention will become apparent from the following detailed description, taken in conjunction with the accompanying drawings.

DETAILED DESCRIPTION OF THE INVENTION

Figure 1:
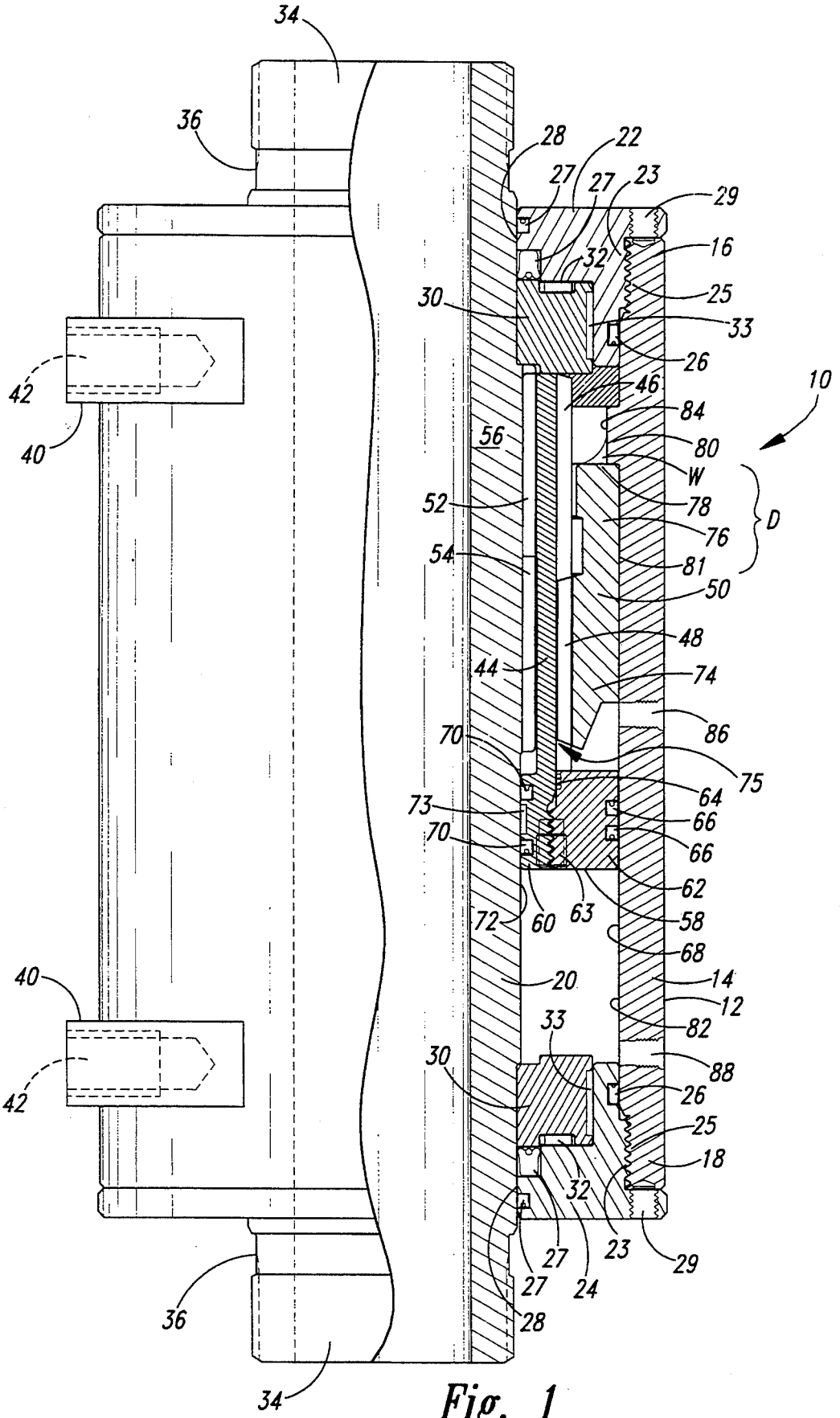
FIG. 1 is a side elevational, sectional view of a fluid-powered rotary splined actuator embodying the present invention.

As shown in the drawings for purposes of illustration, the present invention is embodied in a fluid-powered rotary actuator 10. The actuator 10 includes an elongated housing or body 12 having a cylindrical sidewall 14 and first and second ends 16 and 18, respectively. A rotary output shaft 20 is coaxially positioned within the body 12 and supported for rotation relative to the body, as well as described in more detail below.

A first end cap 22 is threadably attached to the body 12 at the body first end 16 and a second end cap 24 is threadably attached to the body at the body second end 18. Each of the first and second end caps 22 and 24 has a threaded exterior perimeter portions 23 threadably attached to a correspondingly threaded interior portion 25 of the body sidewall. A seal 26 is disposed between each of the first and second end caps 22 and 24 and the body sidewall 14 to provide a fluid-tight seals therebetween. Seals 27 are disposed between each of the first and second end caps 22 and 24 and the shaft 20 to provide fluid-tight seals therebetween.

The shaft 20 extends the full length of the body 12 and extends through a central aperture 28 in each of the first and second end caps 22 and 24. The shaft 20 has a pair of annular bearing support members 30 fixedly mounted thereon for rotation with the shaft, each being adjacent to one of the first and second end caps 22 and 24. The bearing support members 30 each have a thrust bearing 32 and a radial bearing 33 disposed between the bearing support member and the corresponding one of the first and second end caps 22 and 24 to rotatably support the shaft 20 relative to the body 12 against axial and radial thrust.

The first and second end caps 22 and 24 are each locked in place against rotation relative to the body 12 during fluid-powered operation of the actuator 10 by a set screw 29.

The shaft 20 extends outward of the body 12 through the aperture 28 in the first and second end caps 22 and 24, and has drive end portions 34 extending beyond the first and second end caps for coupling to an external device (not shown). Each of the drive end portions 34 has a circumferential groove 36 to assist in coupling the shaft 20 to the external device. It is to be understood that the invention may be practiced with the shaft 20 rotatably driving an external device, or with the shaft being held stationary and the rotational drive being provided by rotation of the body 12.

The body 12 has a pair of outward projecting attachment brackets 40, each being located toward one of the body first and second ends 16 and 18. Each bracket 40 has a pair threaded holes 42 for attachment of the body 12 to a support frame (not shown).

Figure 2:
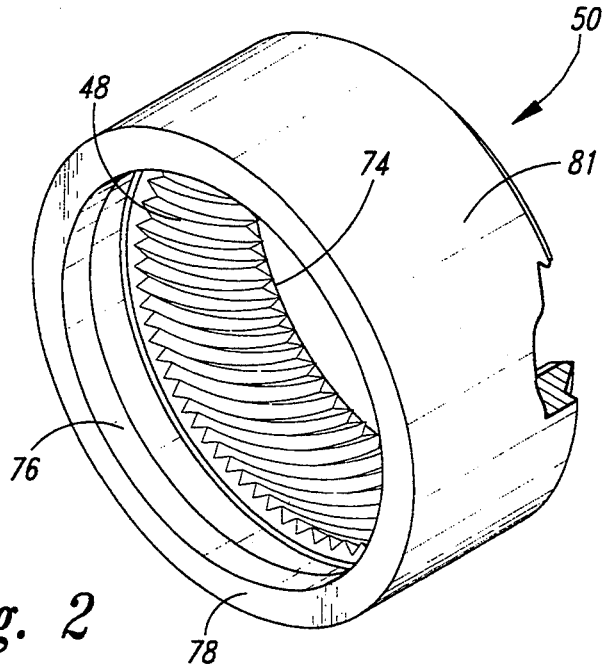
FIG. 2 is an enlarged isometric view of the ring gear shown removed from the actuator of FIG. 1.

The actuator 10 has a linear-to-rotary transmission means which includes an annular piston sleeve 44 which is reciprocally mounted within the body 12 coaxially about the shaft 20. The piston sleeve 44 has outer helical splines 46 over a portion of its length which slidably mesh with inner helical splines 48 of a ring gear 50. The ring gear 50 is shown in FIG. 2 removed from the actuator 10 of FIG. 1. The piston sleeve 44 is also provided with inner helical splines 52 which slidably mesh with outer helical splines 54 provided on a splined intermediate portion 56 of the shaft 20.

The piston sleeve 44 has an annular two-piece piston 58 positioned at an end of the piston sleeve toward the body second end 18. The piston 58 is formed of a head portion 60 and a piston ring 62 which extends about the head portion and is threadably attached thereto. A set screw 63 locks the piston ring 62 in place against rotation relative to the head portion 60. A seal 64 disposed between the head portion 60 and the piston ring 62 provides a fluid-tight seal therebetween. The piston 58 is slidably maintained within the body 12 for axial reciprocal movement, and undergoes longitudinal and rotational movement relative to the body 12 during fluid-powered operation of the actuator 10, as will be described in more detail below.

A pair of seals is carried by the piston ring 62 and disposed between the piston ring and a smooth interior wall surface 68 of the body 12 to provide a fluid-tight seal therebetween. A pair of seals 70 are carried by the head portion 60 and disposed between the head portion and a smooth exterior wall surface 72 of the shaft 20 to provide a fluid-tight seal therebetween. A radial bearing 73 is carried by the head portion 60 and disposed between the head portion and the exterior wall surface 72 of the shaft 20.

The ring gear 50 is positioned coaxially within the body 12 and extends fully about the shaft 20 to define an annular space 75 between the ring gear and the shaft in which the splined portion of the piston sleeve 44 axially reciprocates. The ring gear 50 has a splined annular portion 74 on which the inner helical splines 48 are formed and an annular attachment portion 76 projecting axially away from the splined annular portion toward the body first end 16. The annular attachment portion 76 terminates in a free end 78 axially spaced apart from the splined annular portion 74 by a separation distance "D." The free end 78 of the annular attachment portion 76 is sized to engage a circumferential stop shoulder 80 which projects radially inward from the interior side of the body sidewall 14 at a position toward the body first end 16. The stop shoulder 80 is formed as an integral part of the body sidewall 14.

The ring gear 50 is formed as a separate part from the body 12 with the ring gear inner helical splines 48 and all other portions of the ring gear being fully machined prior to positioning of the ring gear in the fully machined body 12. The ring gear 50 is fixedly joined to the body sidewall 14 to prevent any rotation and axial movement of the ring gear relative to the body 12 by a weld "W" formed in a circumferential bead between the stop shoulder 80 and the free end 78 of the annular attachment portion 76. As will be described below, all torque transmitted between the piston sleeve 40 and the body 12 during fluid-powered operation of the actuator is transmitted through the ring gear 50. With the present invention, pins and receiving holes through the body sidewall and in the ring gear are not necessary, and all the problems associated therewith are avoided.

The stop shoulder 80 is axially located within the body 12 to limit axial movement of the ring gear 50 toward the body first end 16 on assembly of the ring gear in the body and the welding which forms the weld W. The stop shoulder 80 positions the ring gear 50 so that the splined annular portion 74 of the ring gear will have the proper axial position for sliding engagement of the inner helical splines 48 of the ring gear with the outer helical splines 46 of the piston sleeve 44 during fluid-powered operation of the actuator 10. The separation distance D between the free end 78 of the annular attachment portion 76 of the ring gear 50 which is welded to the stop shoulder 80 of the body sidewall 14, and the splined annular portion 74 of the ring gear is selected sufficiently large that the heat generated during the welding which forms the weld W does not distort the splined annular portion 74 sufficient to impair proper fluid-powered operation of the actuator 10. If too great of distortion did occur as a result of the heat generated during the welding, the inner helical splines 48 of the ring gear would bind with the outer helical splines 46 of the piston sleeve 44 and produce increased friction and prevent the smooth and efficient reciprocal movement of the piston sleeve within the body 12. It is noted that while the weld W holds the ring gear 50 securely in position within the body against rotational and axial movement during fluid-powered operation of the actuator 10, the stop shoulder 80 also assists in preventing axial movement of the ring gear 50 toward the body first end 16 during fluid-powered operation.

The ring gear 50 is positioned within the body 12 during assembly of the actuator 10 by inserting the ring gear into the body at the body second end 18 prior to the positioning of the shaft 20 and the annular bearing support members 30 within the body, and prior to installation of the second end cap 24 at the body second end. The ring gear 50 is inserted with the free end 78 of the annular attachment portion facing the body first end 16 and then slid from the body second end 18 toward the body first end 16 until the free end 78 engages the stop shoulder 80 of the body sidewall 14. To allow unobstructed movement of the ring gear 50 toward the stop shoulder 80, the ring gear is formed with a cylindrical exterior sidewall 81 with an outer diameter sized less than the inner diameter of the body sidewall 14 over a lengthwise sidewall portion 82 thereof extending between the body second end 18 and the stop shoulder. The stop shoulder 80 projects radially inward and terminates in a circumferential sidewall portion 84 with an inner diameter less than the outer diameter of the ring gear exterior sidewall 81. While the inner diameter of the ring gear exterior sidewall 81 is smaller than the inner diameter of the body sidewall portion 82 to permit the ring gear to be inserted and move axially within the body 12 on assembly of the actuator 10, the dimensions are very close so that the ring gear will fit snugly within the body 12 and the body sidewall 14 will hold the ring gear tightly in position during welding of the weld W and fluid-powered operation of the actuator 10.

As will be readily understood, reciprocation of the piston 58 within the body 12 occurs when hydraulic oil, air or any other suitable fluid under pressure selectively enters through a first port 86 to one side of the piston toward the body first end 16 or through a second port 88 to the other side of the piston toward the body second end 18. As the piston 58, and the piston sleeve 44 of which the piston is a part, linearly reciprocates in an axial direction within the body 12 as a result of selective application of pressurized fluid to the piston, the outer helical splines 46 of the piston sleeve slidably engage or mesh with the inner helical splines 48 of the ring gear 50 to cause rotation of the piston sleeve. The linear and rotational movement of the piston sleeve 44 is transmitted through the inner helical splines 52 of the piston sleeve slidably engaging or meshing with the outer helical splines 54 of the shaft intermediate portion 56 to cause the shaft 20 to rotate relative to the body 12. The axial movement of the shaft 20 is restricted by the thrust bearings 32, thereby converting all movement of the piston sleeve 44 into rotational movement of the shaft. Depending on the slope and direction of turn of the various helical splines, there may be provided a multiplication of the rotary output of the shaft 20.

The application of fluid pressure to the port 86 produces axial movement of the piston sleeve 44 toward the body second end 18. The application of the fluid pressure to the port 88 produces axial movement of the piston sleeve 44 toward the body first end 16. The actuator 10 provides relative rotational movement between the body 12 and the shaft 20 through the conversion of this linear movement of the piston sleeve 44 into rotational movement of the shaft, in a manner well known in the art.

Figure 3:
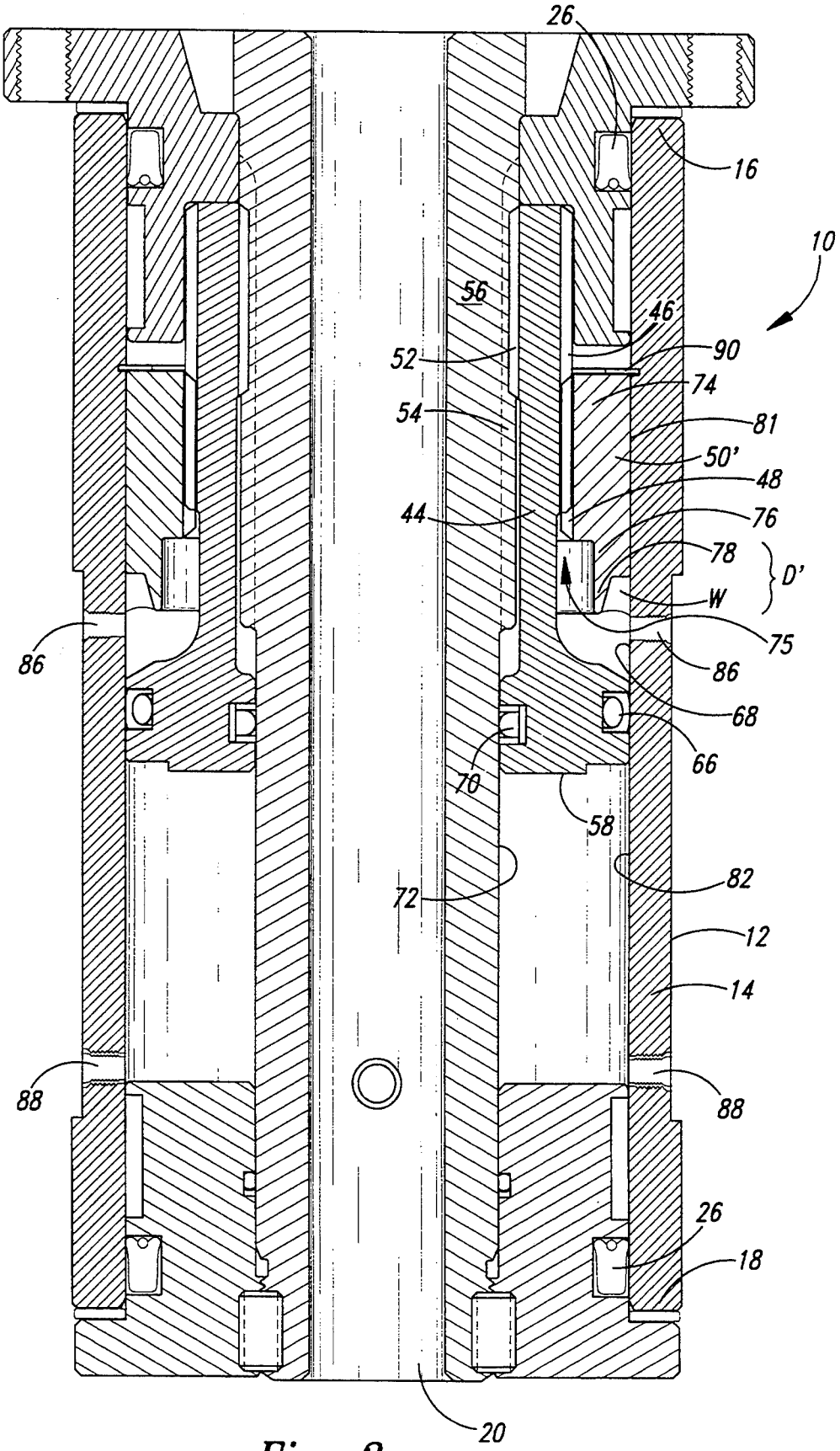
FIG. 3 is a side elevational, sectional view of an alternative fluid-powered rotary splined actuator embodying the present invention.

An alternative embodiment of the fluid-powered rotary actuator 10 utilizing the present invention is illustrated in FIG. 3. For ease of understanding, the components of this alternative embodiment will be similarly numbered with those of the first embodiment of FIG. 1 when of a similar construction. Only the significant differences in construction will be described in detail.

In the alternative embodiment of FIG. 3, the stop shoulder 80 is replaced by a snap ring 90 that serves much the same function as the stop shoulder to locate a ring gear 50' in the body 12 during assembly. The snap ring 90 is axially located within the body 12 to limit axial movement of the ring gear 50' toward the body first end 16 during assembly of the ring gear in the body, and the welding of the ring gear to the body sidewall 14. In this alternative embodiment the orientation of the ring gear 50' in the body 12 is reversed with the splined annular portion 74 being inserted into the body first upon assembly and then moved into position engaging the snap ring 90 to position the ring gear in the body for welding of the weld W. As described above, the free end 78 of the ring gear attachment portion 76 is welded to the body 12, however, the weld W is formed by welding the free end directly to the interior wall surface 68 of the body at a distance from the snap ring toward the body second end 18. The weld W is axially spaced apart from the splined annular portion 74 by a separation distance D' sufficient to prevent the heat generated during welding from distorting the splined annular portion enough to impair proper fluid-powered operation of the actuator 10.

Figure 4:
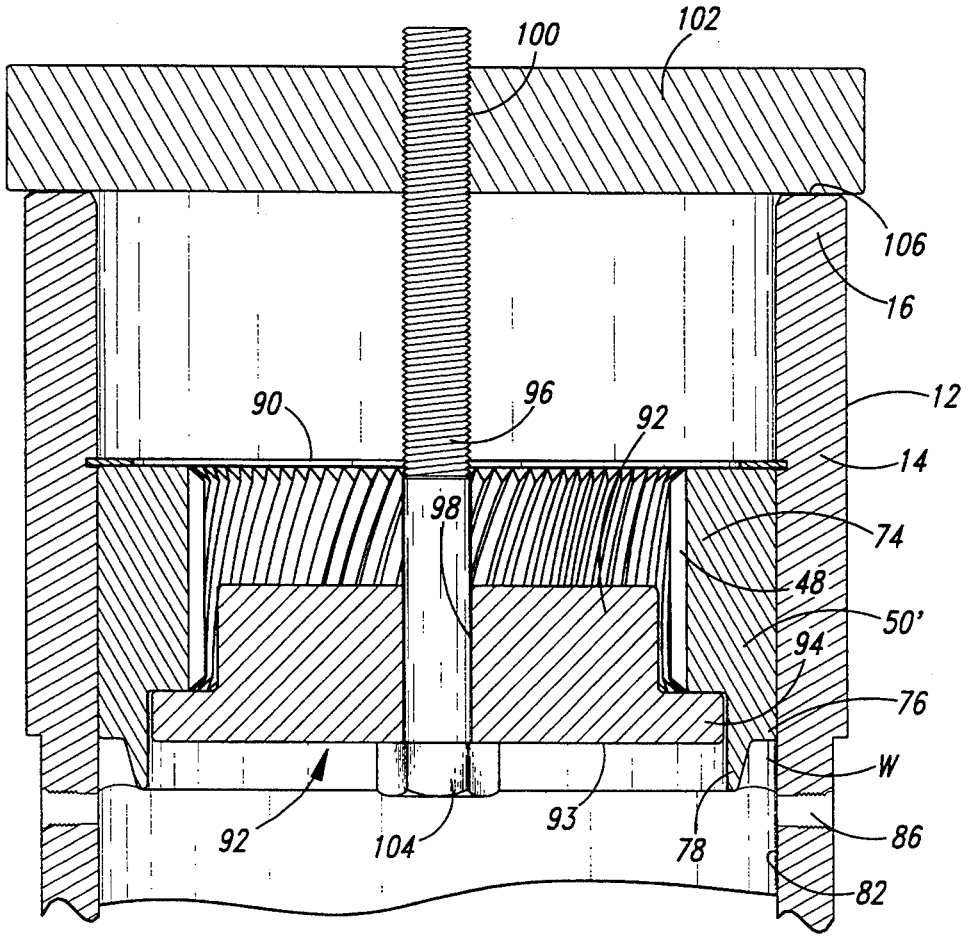
FIG. 4 is a side elevational, sectional view of a ring gear being held by a tool in position for welding within the body of the actuator of FIG. 3.

The steps of assembling the ring gear 50' in the body 12 and forming the weld W have been generally described above. It is important that the ring gear 50' have the proper coaxial alignment with the body 12 when it is being welded thereto. To accomplish this, after the ring gear 50' is inserted in the body 12 and positioned engaging the stop shoulder 80 of FIG. 1 or the snap ring 90 of FIG. 3, a tool 92 (shown in FIG. 4 used with the ring gear 50' of FIG. 3) is used to snug the ring gear against the stop shoulder/snap ring and hold it squared up while the weld W is formed. This avoids the ring gear being welded within the body 12 in a cocked position (i.e., out of coaxial alignment with the body), which would cause binding of the piston sleeve 44 and the shaft 20 during fluid-powered operation.

The tool 92 includes a circular clamp portion 93 with a flange portion 94 which, when positioned against the ring gear 50', engages the end of the splined annular portion 74 toward the body second end 18. The tool 92 also includes a bolt 96 which extends through a central aperture 98 in the circular clamp portion 93 and threadably engages a threaded central aperture 100 in a circular end cap 102 positioned at the body first end 16 outward of the body 12. By rotation of the bolt 96 by its head 104, the circular cap 102 is drawn into tight engagement with an annular end wall 106 of the body 12 at the body first end 16, and the circular clamp portion 93 applies a force against the ring gear 50' in the direction toward the body first end 16. Continued rotation of the bolt head 104 until a selected preloading force is achieved on the ring gear 50' securely and tightly seats the ring gear against the snap ring 90 and holds it in proper coaxial alignment with the body 12 during the welding that forms the weld W. Once the weld W is formed, the tool 92 is removed from the body 12 and the assembly of the other components of the actuator 10 can be continued.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered rotary actuator for providing rotary movement between first and second external members, comprising:

a body having a longitudinal axis, and first and second ends, said body having a generally cylindrical interior sidewall portion, said body being adapted for coupling to the first external member;

a drive member extending generally coaxially within said body and supported for rotation relative thereto, said drive member having a grooved, outwardly facing circumferential sidewall portion positioned within said body and an end portion adapted for coupling to the second external member to provide the rotational movement between the first and second external members;

a ring gear positioned generally coaxially within said body and extending about said drive member with an annular space therebetween, said ring gear having a grooved, inwardly facing circumferential sidewall portion and an attachment portion projecting axially away from said ring gear grooved sidewall portion, said ring gear being formed as a separate part from said body and said ring gear grooved sidewall portion being formed prior to positioning of said ring gear in said body, said attachment portion termination at a free end axially spaced apart from said ring gear grooved sidewall portion by a separation distance, said ring gear being fixedly attached to said body to prevent rotation therebetween by a weld between said attachment portion free end and said body interior sidewall portion, said separation distance being sufficiently large that the heat of said weld does not distort said ring gear sufficient to impair operation of the actuator;

a piston mounted for reciprocal axial movement within said body in response to selective application of pressurized fluid thereto; and a torque-transmitting annular member positioned generally coaxially within said body in said annular space between said ring gear and said drive member and extending about said drive member, said annular member being mounted for reciprocal axial movement within said body in response to said reciprocal axial movement of said piston, said annular member having a grooved, inwardly facing circumferential sidewall portion engaging said drive member grooved sidewall portion as said annular member reciprocally moves within said body, and a grooved, outwardly facing circumferential sidewall portion engaging said ring gear grooved sidewall portion as said annular member reciprocally moves within said body to translate said axial movement of said piston toward said body first end into one of clockwise or counterclockwise relative rotational movement between said drive member and said body and said axial movement of said piston toward said body second end into the other of clockwise or counterclockwise relative rotational movement between said drive member and said body.

2. The fluid-powered rotary actuator of claim 1, further including a stop member engaged by said ring gear, said stop member being axially located within said body toward said body first end to limit movement of said ring gear toward said body first end on assembly of said ring gear in said body, said stop member positioning said ring gear grooved sidewall portion in a selected axial position when said weld is formed.

3. The fluid-powered rotary actuator of claim 2 wherein said stop member is a stop shoulder formed integral with said body interior sidewall portion and sized to engage said ring gear attachment portion free end.

4. The fluid-powered rotary actuator of claim 2 wherein said stop member is a snap ring held by said body interior sidewall portion against axial movement within said body and sized to engage said ring gear grooved sidewall portion.

5. The fluid-powered rotary actuator of claim 2 wherein said ring gear has an outer first diameter, and said body interior sidewall portion between said stop member and said second end has an inner second diameter greater than said first diameter to permit said ring gear to be inserted into said body from said second end on assembly and moved axially unobstructed toward said first end and into engagement with said stop member prior to forming said weld.

6. The fluid-powered rotary actuator of claim 1 wherein said drive member grooved sidewall portion and said annular member inwardly facing sidewall portion each have splines which slidably intermesh with each other and said ring gear grooved sidewall portion and said annular member outwardly facing sidewall portion each have splines which slidably intermesh with each other.

7. A method of manufacturing a fluid-powered rotary actuator which provides rotary movement between first and second external members, comprising:

providing a body having a longitudinal axis, and first and second ends, said body having a generally cylindrical interior sidewall portion, said body being adapted for coupling to the first external member;

providing a drive member extending generally coaxially within said body and supported for rotation relative thereto, said drive member having a grooved, outwardly facing circumferential sidewall portion positioned within said body and an end portion adapted for coupling to the second external member to provide the rotational movement between the first and second external members;

forming a ting gear sized for positioning generally coaxially within said body and extending about said drive member to define an annular space therebetween, said ring gear having a grooved, inwardly facing circumferential sidewall portion and an attachment portion projecting axially away from said ring gear grooved sidewall portion with said attachment portion termination at a free end axially spaced apart from said ring gear grooved sidewall portion by a separation distance, said separation distance being sufficiently large that the heat of a weld between said attachment portion and said body interior sidewall portion does not distort said ring gear sufficient to impair operation of the actuator, said ring gear being formed as a separate part from said body and said ring gear grooved sidewall portion being formed prior to positioning of said ring gear in said body;

positioning said ring gear in said body;

fixedly attaching said ring gear to said body to prevent rotation therebetween by forming said weld between said attachment portion and said body interior sidewall portion;

providing a piston mounted for reciprocal axial movement within said body in response to selective application of pressurized fluid thereto; and providing a torque-transmitting annular member positioned generally coaxially within said body in said annular space between said ring gear and said drive member and extending about said drive member, said annular member being mounted for reciprocal axial movement within said body in response to said reciprocal axial movement of said piston, said annular member having a grooved, inwardly facing circumferential sidewall portion engaging said drive member grooved sidewall portion as said annular member reciprocally moves within said body, and a grooved, outwardly facing circumferential sidewall portion engaging said ring gear grooved sidewall portion as said annular member reciprocally moves within said body to translate said axial movement of said piston toward said body first end into one of clockwise or counterclockwise relative rotational movement between said drive member and said body and said axial movement of said piston toward said body second end into the other of clockwise or counterclockwise relative rotational movement between said drive member and said body.

8. The method of claim 7, which further includes providing a stop member axially located within said body toward said body first end in position to limit movement of said ring gear toward said body first end on assembly of said ring gear in said body, said stop member positioning said ring gear grooved sidewall portion in a selected axial position when said weld is formed; and positioning said ring gear within said body in engagement with said stop member.

9. The method of claim 8 wherein providing said stop member includes forming a stop shoulder integral with said body interior sidewall portion with a size to engage said attachment portion.

10. The method of claim 9 wherein said weld is formed between said attachment portion and said stop shoulder.

11. The method of claim 8 wherein providing said stop member includes providing a snap ring held by said body interior sidewall portion against axial movement within said body with said snap ring having a size to engage said ring gear grooved sidewall portion.

12. The method of claim 8, further including forming said ring gear with an outer first diameter, forming said body interior sidewall portion between said stop member and said second end with an inner second diameter greater than said first diameter, inserting said ring gear into said body from said second end on assembly of the actuator, and upon insertion, moving said ring gear axially unobstructed toward said first end and into engagement with said stop member prior to forming said weld.

13. The method of claim 7 wherein said drive member grooved sidewall portion and said annular member inwardly facing sidewall portion are each formed with splines which slidably intermesh with each other and said ring gear grooved sidewall portion and said annular member outwardly facing sidewall portion are each formed with splines which slidably intermesh with each other.

14. The method of claim 8, wherein providing said stop member includes forming a stop shoulder integral with said body interior sidewall portion with a size to engage said attachment portion free end.

15. The method of claim 14 wherein said weld is formed between said attachment portion free end and said stop shoulder.

* * * * *

UNITED STATES PATENT AND TRADEMARK OFFICE

CERTIFICATE OF CORRECTION

PATENT NO. : 5,447,095

DATED : September 5, 1995

INVENTOR(S) : Paul P. Weyer

It is certified that error appears in the above-indentified patent and that said Letters Patent is hereby corrected as shown below:

In column 9, claim 7, line 57, please delete "ting" and insert therefor --ring --.

Signed and Sealed this

Sixteenth Day of January, 1996

Bruce Lehman

*Attest:*

BRUCE LEHMAN

*Attesting Officer*

*Commissioner of Patents and Trademarks*